US009163345B2

(12) United States Patent
Gweon et al.

(10) Patent No.: US 9,163,345 B2
(45) Date of Patent: Oct. 20, 2015

(54) DRUM WASHING MACHINE

(71) Applicant: SAMSUNG ELECTRONICS CO., LTD., Suwon-si, Gyeonggi-do (KR)

(72) Inventors: Tae Sung Gweon, Osan-si (KR); Kyung Han Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 375 days.

(21) Appl. No.: 13/737,539

(22) Filed: Jan. 9, 2013

(65) Prior Publication Data

US 2013/0180291 A1 Jul. 18, 2013

(30) Foreign Application Priority Data

Jan. 12, 2012 (KR) ..... 10-2012-0003813

(51) Int. Cl.
*D06F 25/00* (2006.01)
*D06F 58/24* (2006.01)
*D06F 37/26* (2006.01)

(52) U.S. Cl.
CPC ..... *D06F 25/00* (2013.01); *D06F 37/267* (2013.01); *D06F 58/24* (2013.01)

(58) Field of Classification Search
CPC ..... D06F 25/00; D06F 37/267; D06F 58/24
USPC ..... 68/20; 34/77
See application file for complete search history.

(56) References Cited

U.S. PATENT DOCUMENTS 6,282,928 B1 * 9/2001 Fukumoto et al. ..... 68/20
6,499,770 B1 * 12/2002 Glista et al. ..... 285/223
7,398,798 B2 * 7/2008 Ostan et al. ..... 138/121
2004/0079121 A1 * 4/2004 Yabuuchi et al. ..... 68/19.2
2004/0221474 A1 * 11/2004 Slutsky et al. ..... 34/319
2005/0229650 A1 * 10/2005 Kim et al. ..... 68/20
2005/0246920 A1 * 11/2005 Yabuuchi et al. ..... 34/515
2006/0075577 A1 * 4/2006 Jeong et al. ..... 8/158
2006/0096327 A1 * 5/2006 Park et al. ..... 68/3 R
2006/0162394 A1 * 7/2006 Kim et al. ..... 68/20
2006/0169006 A1 * 8/2006 Lim et al. ..... 68/13 R (Continued)

FOREIGN PATENT DOCUMENTS

EP 1 852 535 A1 11/2007
FR 2 623 531 5/1989

(Continued)

OTHER PUBLICATIONS

Machine translation of JP 2008-161396 A, no date.*

(Continued)

*Primary Examiner* — Joseph L Perrin

(74) *Attorney, Agent, or Firm* — Staas & Halsey LLP

(57) ABSTRACT

A drum washing machine including a cabinet, a tub disposed at an inside of the cabinet, a drum rotatively disposed at an inside of the tub, a condensing duct configured to condense moisture in air that is introduced from an inside of the drum, and a drying duct configured to heat air being introduced from the condensing duct to supply the heated air to an inside of the drum, wherein the condensing duct is coupled to a rear of the tub, while the drying duct is positioned at an upper portion of the condensing duct and is coupled to the cabinet, and in between the condensing duct and the drying duct, a buffer coupling member configured to mediate the condensing duct and the drying duct is provided.

23 Claims, 7 Drawing Sheets

(56) References Cited

U.S. PATENT DOCUMENTS

| | | | | |
|---|---|---|---|---|
| 2006/0260367 | A1 | 11/2006 | Byun | |
| 2008/0265570 | A1* | 10/2008 | McPheat | 285/235 |
| 2010/0107703 | A1* | 5/2010 | Hisano et al. | 68/20 |

FOREIGN PATENT DOCUMENTS

| | | | |
|---|---|---|---|
| GB | 2 248 920 | A | 4/1992 |
| JP | 2007-190042 | | 8/2007 |
| JP | 2008-113978 | | 5/2008 |
| JP | 2008-161396 | | 7/2008 |
| KR | 10-2005-0082862 | | 8/2005 |
| KR | 10-2006-0095808 | | 9/2006 |
| WO | 2005/090670 | A2 | 9/2005 |

OTHER PUBLICATIONS

Extended European Search Report issued Jun. 4, 2013 in corresponding European Application No. 13150637.0.

* cited by examiner

DRUM WASHING MACHINE

CROSS-REFERENCE TO RELATED APPLICATIONS

This application claims the benefit of Korean Patent Application No. 10-2012-0003813, filed on Jan. 12, 2012, in the Korean Intellectual Property Office, the disclosure of which is incorporated herein by reference.

BACKGROUND

1. Field

Embodiments of the present disclosure relate to a drum washing machine, and more particularly, to a drum washing machine having an improved assembly structure of a drying duct and a condensing duct.

2. Description of the Related Art

In general, a drum washing machine having a drying function is provided with a drying apparatus configured to dry laundry as heated air by a drying heater blows at an inside of an accommodating space in which the laundry is accommodated, and by using the drying apparatus as such, the drying function is independently performed, or the drying function is performed after a spin-dry is completed while interacting with a washing function.

In general, the drying apparatus of a washing machine is configured to evaporate the moisture of a laundry by supplying the heated air being heated by a heating apparatus to an inside of a drum to apply heat on the laundry, and by discharging the evaporated moisture after condensing the evaporated moisture, the drying of the laundry takes place.

The drying apparatus as such is configured to supply heated air to an inside of a drum, and is provided with a drying duct having a heating apparatus while one end of the drying duct is connected to a discharging hole of a blower fan and the other end of the drying duct is connected to communicate with an inside of the drum. The drying apparatus as such is also provided with a condensing duct configured to discharge the moist air formed at an inside of the drum after condensing the moisture in a process of guiding the moist air toward the blower fan, and the condensing duct has one end being connected to an inside of the drum to communicate with the inside of the drum, and the other end being connected to an intake hole of the blower fan.

The condensing duct and the drying duct may be assembled to a cabinet, and as such, the delivery of a vibration, which is generated by the driving of the drum washing machine, may be minimized, but a separate space configured for the drying duct and the condensing duct is needed. Thus, the miniaturization of the drum washing machine is difficult.

Meanwhile, the condensing duct and the drying duct may be assembled to a tub. In such case, securing an assembly space is easy, but since the vibration of the tub is directly delivered to the cabinet, a particular apparatus is needed to ensure durability.

SUMMARY

Therefore, it is an aspect of the present disclosure to provide a drum washing machine having an improved assembly structure of a drying duct and a condensing duct.

Additional aspects of the disclosure will be set forth in part in the description which follows and, in part, will be apparent from the description, or may be learned by practice of the disclosure.

In accordance with one aspect of the present disclosure, a drum washing machine includes a cabinet, a tub, a drum, a condensing duct, and a drying duct. The tub may be disposed at an inside of the cabinet. The drum may be rotatively disposed at an inside of the tub. The condensing duct may be configured to condense moisture in air that is introduced from an inside of the drum. The drying duct may be configured to heat air being introduced from the condensing duct to supply the heated air to an inside of the drum. The condensing duct may be coupled to a rear of the tub, while the drying duct is positioned at an upper portion of the condensing duct and is coupled to the cabinet, and in between the condensing duct and the drying duct, a buffer coupling member configured to mediate the condensing duct and the drying duct may be provided.

A front side panel of the condensing duct that composes the condensing duct may be coupled to a rear surface of the tub in a closely adhered manner.

The buffer coupling member may be formed of flexible material.

The buffer coupling member may be composed of a hose having a shape of a pipe.

The buffer coupling member may be a hose having a wrinkle portion having a mountain part and a valley part alternately disposed.

The buffer coupling member may be a hose having at least one step portion having a width thereof being narrowed in a direction from the condensing duct to the drying duct.

The drum washing machine may further include a guide portion. The guide portion may be provided in between the buffer coupling member and the drying duct, and configured to guide the coupling of the buffer coupling member and the drying duct.

The drying duct may include a front surface panel to be coupled to the cabinet.

The front surface panel of the drying duct may be fastened to the cabinet by using a screw.

The condensing duct may include a coupling protrusion portion protruded toward an outer side of the condensing duct to be coupled to the tub, and the tub may include a coupling groove to be coupled to the condensing duct.

The coupling protrusion portion of the condensing duct may be insertedly assembled into the coupling groove of the tub.

The drum washing machine may further include a sealing member. The sealing member may be provided in between the coupling protrusion portion of the condensing duct and the coupling groove of the tub to prevent air from leaking.

The condensing duct may be fastened to the tub by using a screw.

In accordance with another aspect of the present disclosure, a drum washing machine having a condensing duct and a drying duct includes a cabinet, a tub and a drum. The tub may be disposed at an inside of the cabinet. The drum may be rotatively disposed at an inside of the tub. A mounting portion having at least a portion thereof open for air to move may be provided at one side of the drying duct. A buffer coupling member configured to couple the drying duct to the condensing duct and configured to buffer a vibration of the drum washing machine may be mounted at the mounting portion.

One side of the buffer coupling member may be coupled to a rim portion of an inner side of the mounting portion, while the other one side of the buffer coupling member may be coupled to an outer side of the drying duct.

The buffer coupling member may be composed of a hose having flexibility so that a length of the buffer coupling member is contract and extended.

The hose may include a wrinkle portion having a mountain part and a valley part alternately disposed.

The hose may include at least one step portion having a width thereof being narrowed in a direction from the condensing duct to the drying duct.

The drum washing machine may further include a guide portion. The guide portion may be provided in between the buffer coupling member and the drying duct, and configured to guide the coupling of the buffer coupling member and the drying duct.

The guide portion may be provided at an inner side of the buffer coupling member to mediate the drying duct and the buffer coupling member.

In accordance with another aspect of the present disclosure, a drum washing machine includes a cabinet, a tub, a drum, a condensing duct, a drying duct and a buffer coupling member. The tub may be disposed at an inside of the cabinet. The drum may be rotatively disposed at an inside of the tub. The condensing duct may be connected to the tub, and configured to condense moisture in air that is introduced from an inside of the drum. The drying duct configured to heat air being introduced from the condensing duct to supply the heated air to an inside of the drum. The buffer coupling member may be configured to connect the condensing duct to the drying duct to prevent a motion or a vibration of the tub from being delivered to the cabinet through the condensing duct.

The buffer coupling member may be provided in a way that the condensing duct is moved relative to the drying duct, as to prevent the motion or the vibration of the tub from being delivered to the drying duct through the condensing duct.

The drying duct may be coupled to the cabinet.

The buffer coupling member may be provided as a pipe-shape hose of flexible material.

The buffer coupling member may include a wrinkle portion having a mountain part and a valley part alternately disposed.

As described above, the drum washing machine of the present disclosure, with respect to an assembly of a drying duct and a condensing duct, is capable of securing an assembly space, and thus, without increasing the overall size of the drum washing machine, increasing the capacity of the drum washing machine is possible. In addition, the delivery of vibration may be minimized.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
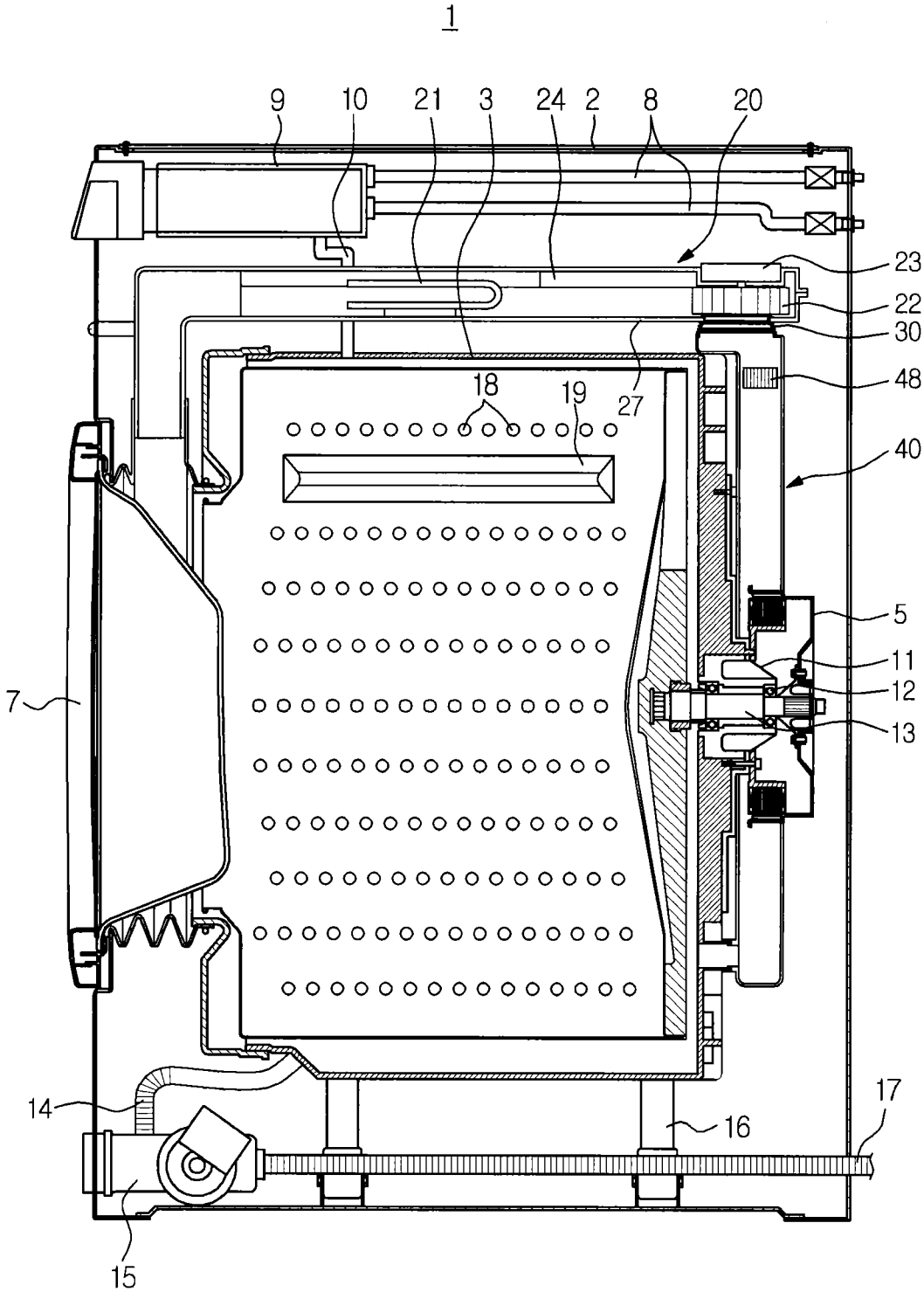
FIG. 1 is a drawing schematically illustrating a drum washing machine in accordance with one embodiment of the present disclosure.

Reference will now be made in detail to the embodiments of the present disclosure, examples of which are illustrated in the accompanying drawings, wherein like reference numerals refer to like elements throughout.

Figure 2:
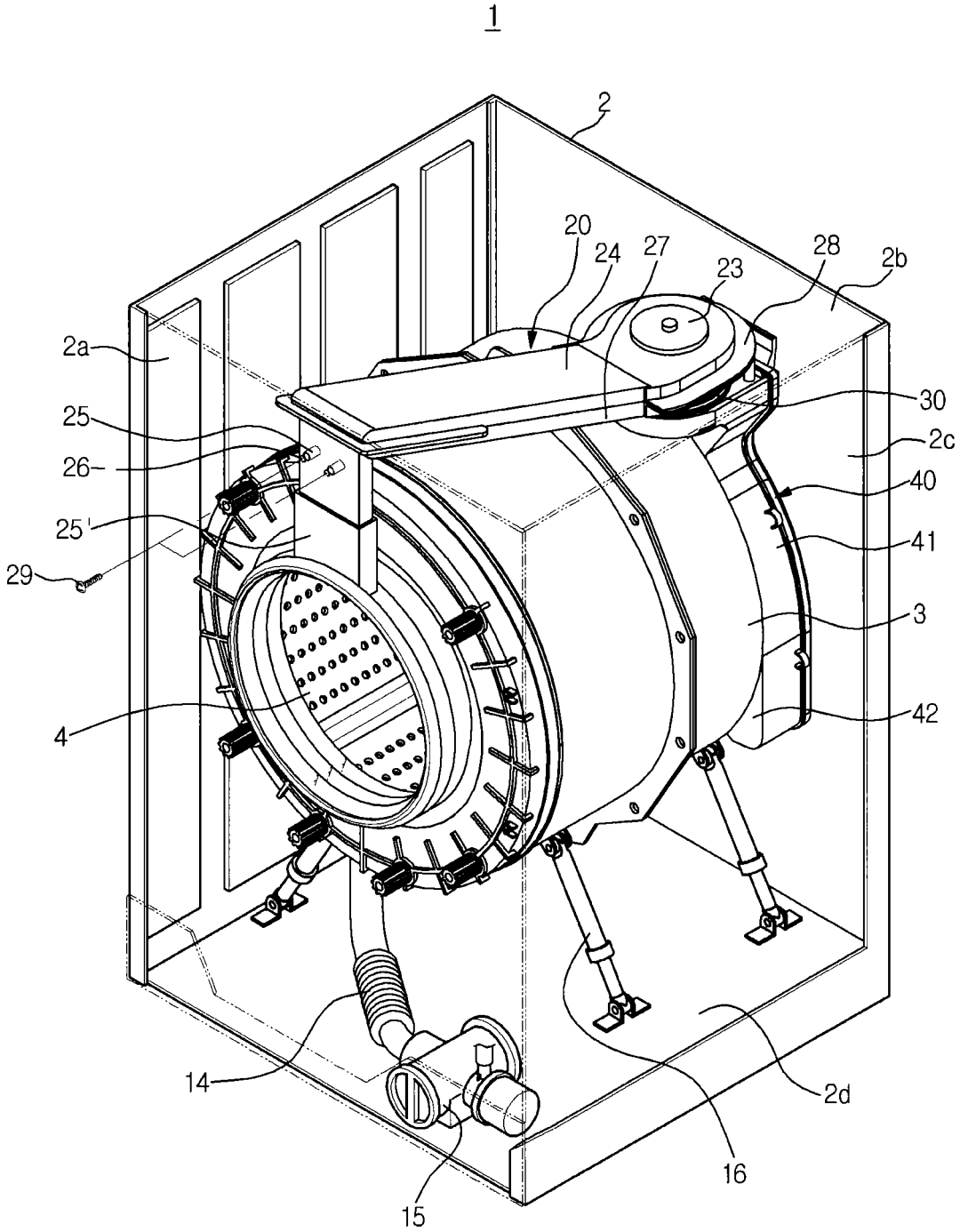
FIG. 2 is a drawing schematically illustrating a coupling state of a drying duct and a condensing duct of the drum washing machine in accordance with one embodiment of the present disclosure.

FIG. 1 is a drawing schematically illustrating a drum washing machine in accordance with one embodiment of the present disclosure, and FIG. 2 is a drawing schematically illustrating a coupling state of a drying duct and a condensing duct of the drum washing machine in accordance with one embodiment of the present disclosure.

As illustrated on FIGS. 1 to 2, the drum washing machine 1 includes a cabinet 2, a tub 3 disposed at an inside of the cabinet 2, a drum 4 rotatively disposed at an inside of the tub 3, and a motor 5 to drive the drum 4.

The cabinet 2 includes frames 2*a*, 2*b*, 2*c*, and 2*d*, and the frames 2*a*, 2*b*, 2*c*, and 2*d* include a front surface frame 2*a* and a rear surface frame 2*b* forming a front surface and a rear surface of the cabinet 2, respectively, and a side surface frame 2*c* and a lower surface frame 2*d* connecting the front surface frame 2*a* to the rear surface frame 2*b* and forming a side surface and a lower surface of the cabinet 2, respectively.

At the front surface frame 2*a* of the cabinet 2, an input portion is formed so that a laundry may be input to an inside of the drum 4. The input portion is open/closed by a door 7 installed at the front surface frame 2*a* of the cabinet 2.

At an upper portion of the tub 3, a water supply pipe 8 is installed to supply washing water to the tub 3. One side of the water supply pipe 8 is connected to an outside water supply source (not shown), and the other side of the water supply pipe 8 is connected to a detergent supply apparatus 9.

The detergent supply apparatus 9 is connected to the tub 3 through a connecting pipe 10. The water being supplied through the water supply pipe 8 passes through the detergent supply apparatus 9, and is supplied to an inside of the tub 3 along with detergent.

The tub 3 is supported by a damper 16. The damper 16 connects a lower surface at an inner side of the cabinet 2 to an outer surface of the tub 3. In addition, the damper 16, other than the lower surface at an inner side of the cabinet 2, may be positioned at an upper side or a right/left side of the cabinet 2 to support the tub 3.

At a rear surface of the drum 4, a driving shaft 13 configured to deliver the driving force of the motor 5 is connected. At a circumferential surface of the drum 4, a plurality of penetrating holes 18 is formed for the flow of washing water, and at an inner circumferential surface of the drum 4, a plurality of lifters 19 is installed so that the ascension and the descension of the laundry may take place when the drum 4 is rotated.

In between the drum 4 and the motor 5, the driving shaft 13 is disposed. One end of the driving shaft 13 is connected to a rear surface panel of the drum 4, and the other end of the driving shaft 13 is extended toward an outer side of a rear wall of the tub 3. When the motor 5 rotates the driving shaft 13, the drum 4 connected to the driving shaft 13 is rotated on the driving shaft 13.

At a rear wall of the tub 3, a bearing housing 11 is installed to rotatively support the driving shaft 13. The bearing housing 11 may be provided in aluminum alloy, and may be inserted into a rear wall of the tub 3 when the tub 3 is injection-molded. In between the bearing housing 11 and the driving shaft 13, bearings 12 are installed so that the driving shaft 13 may be smoothly rotated.

At a lower portion of the tub 3, a drain pump 15 configured to discharge the water at an inside of the tub 3 to an outside, a connection hose 14 connecting the tub 3 and the drain pump 15 so that the water at an inside of the tub 3 may be introduced to the drain pump 15, and a drain hose 17 configured to guide the water that is pumped by the drain pump 15 to an outside the cabinet 2 are provided.

At the tub 3, drying apparatuses 20 and 40 are mounted to dry the air at an inside of the tub 3 and to re-supply the dried air to an inside of the tub 3.

The drying apparatuses 20 and 40 include a condensing duct 40 to condense the moisture in the air that is introduced from the tub 3, a drying duct 20 to dry the air introduced from the condensing duct 40 by applying heat on the air, and a blower fan 22 disposed in between the condensing duct 40 and the drying duct 20 to form a flow of air so that the air introduced to the condensing duct 40 may be introduced to an inside of the tub 3 through the drying duct 20. At an inside of the drying duct 20, a heater 21 is provided to heat the air at the inside of the drying duct 20. At an inside of the condensing duct 40, a condenser 48 is provided to condense the moisture in the air at an inside of the condensing duct 40. The condenser 48 is configured to perform a role to remove the moisture in the high-temperature, high-humidity air that absorbs the moisture included in the laundry at an inside a drum 30. The air having the moisture removed is introduced to the drying duct 20 through a blower fan 22. Thus, the drying duct 20 and the condensing duct 40 are needed to be coupled to each other. To couple the drying duct 20 and the condensing duct 40 as such, a buffer coupling member 30 may be positioned therebetween. The description of the buffer coupling member 30 will be described later.

As described above, the damper 16 may be able to support a lower side of the tub 3 from a lower surface at an inner side of the cabinet 2. The condensing duct 40 coupled to the tub 3, the buffer coupling member 30 having one side thereof being coupled to the condensing duct 40 while the other side thereof is coupled to the drying duct 20, and the drying duct 20 being coupled to the cabinet 2 may composed buffer units 20, 30, and 40. The buffer units 20, 30, and 40 enable the tub 3 to be fixed at an upper side of the drum washing machine 1. A lower side of the tub 3 is fixed by the damper 16, while an upper side of the tub 3 is fixed by the buffer units 20, 30, and 40, and thus the motion of the tub 3, which is generated by the driving of the drum washing machine 1, being delivered to the cabinet 2 may be prevented. Particularly, the prevention of the motion of the tub 3 being delivered may be possible by the buffer coupling member 30 that is positioned in between the drying duct 20 and the condensing duct 40, and the such will be described later.

Figure 3:
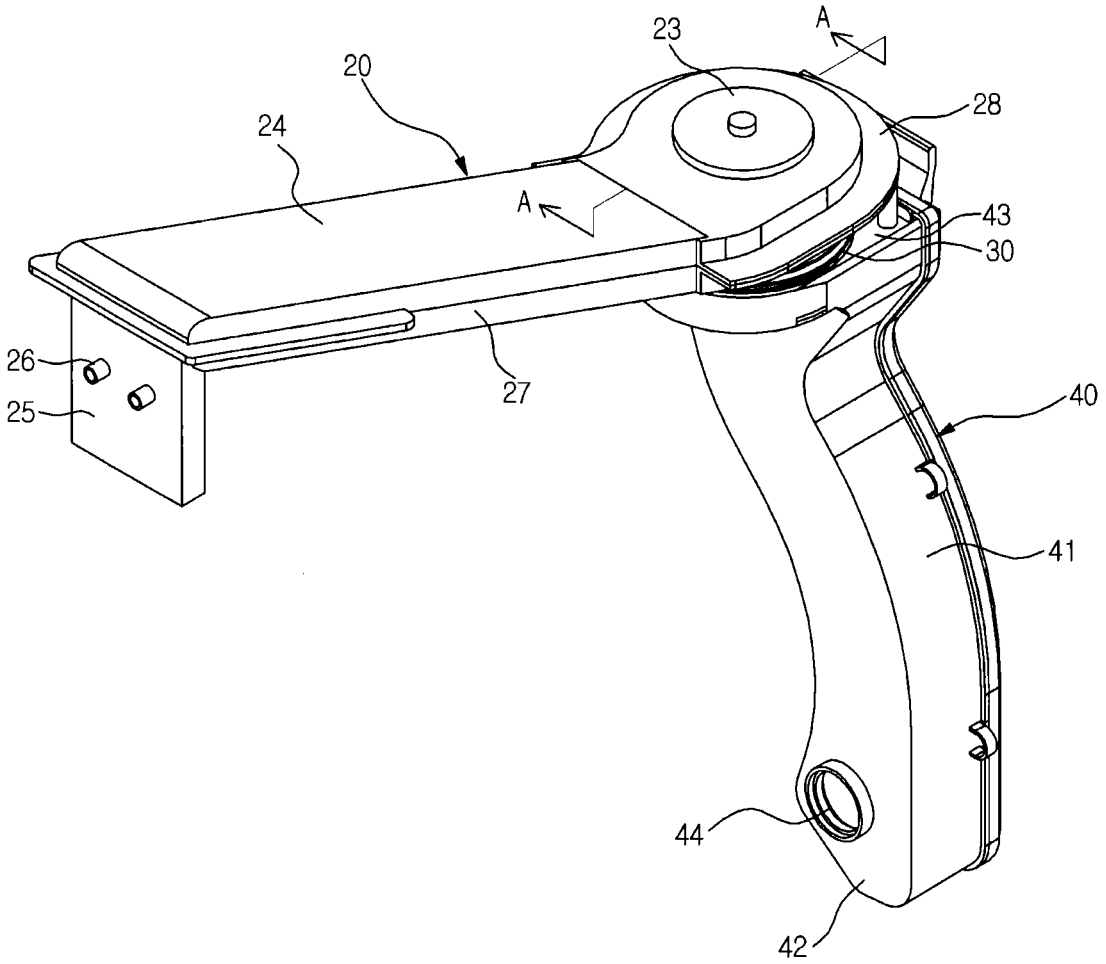
FIG. 3 is a drawing illustrating a coupling state of a drying duct and a condensing duct of the drum washing machine in accordance with one embodiment of the present disclosure.
Figure 4:
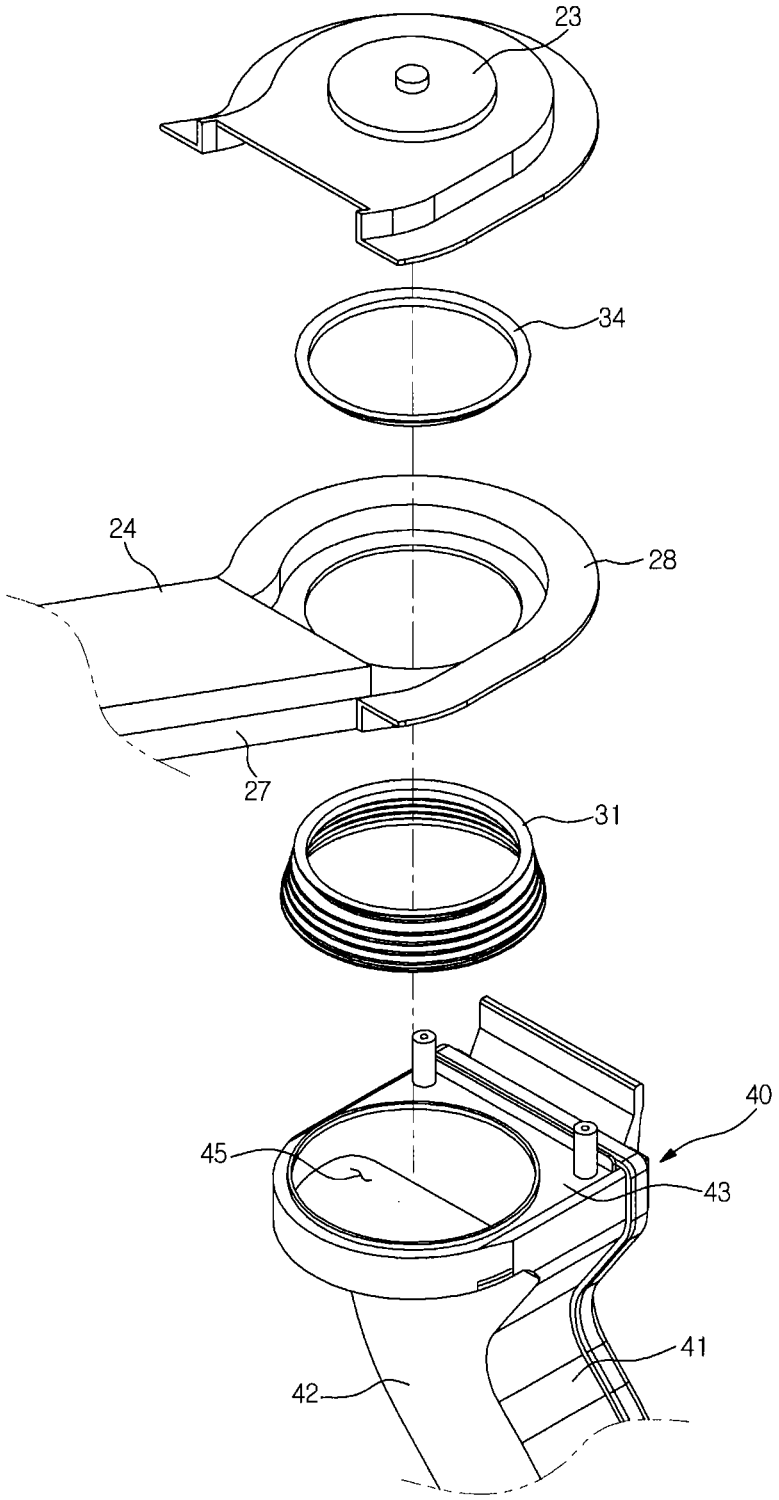
FIG. 4 is an exploded view illustrating a coupling portion of the drying duct and the condensing duct of the drum washing machine in accordance with one embodiment of the present disclosure.
Figure 5:
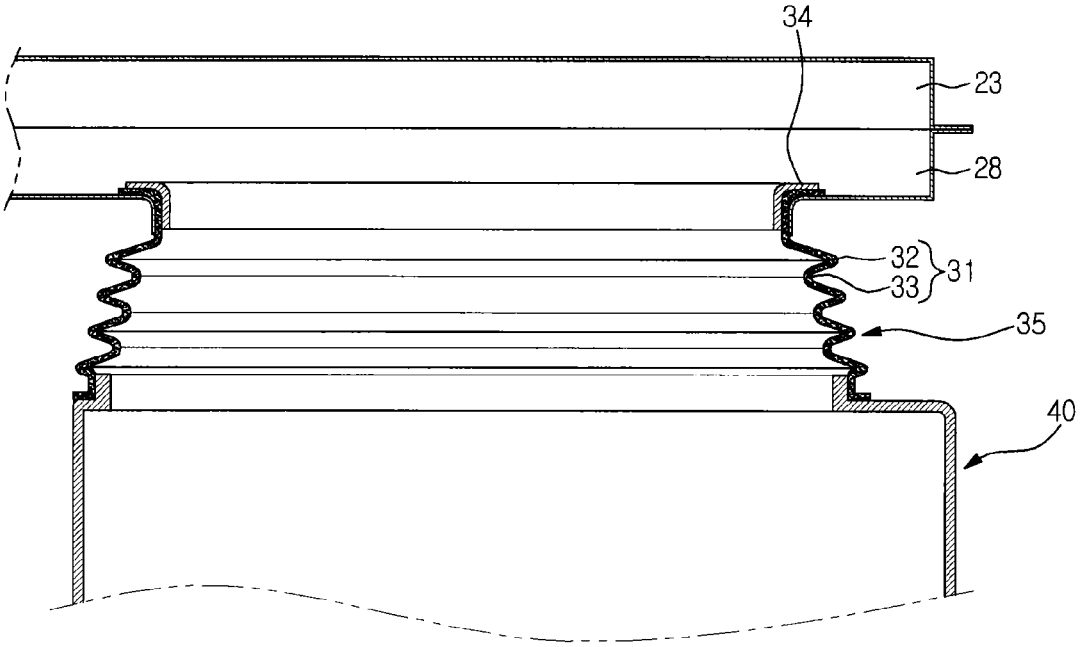
FIG. 5 is a cross-sectional view illustrating a cross section of the 'A' portion on FIG. 3.

FIG. 3 is a drawing illustrating a coupling state of the drying duct and the condensing duct of the drum washing machine in accordance with one embodiment of the present disclosure, FIG. 4 is an exploded view illustrating a coupling portion of the drying duct and the condensing duct of the drum washing machine in accordance with one embodiment of the present disclosure, and FIG. 5 is a cross-sectional view illustrating a cross section of the 'A' portion on FIG. 3.

As illustrated on FIGS. 3 to 5, the drying duct 20 and the condensing duct 40 are coupled to each other through the buffer coupling member 30.

The drying duct 20 includes duct bodies 24 and 27, and duct heads 23 and 28. The duct bodies 24 and 27 include an upper panel 24 and a lower panel 27, and are provided with the heater 21 at an inner side thereof. The duct heads 23 and 28 include an upper cover 23, and a mounting portion 28 having an inner side recessed. At an inner side of the mounting portion 28, the blower fan 22 may be positioned.

At the duct bodies 24 and 27, other than the heater 21, may be provided with various electronic devices such as a sensor (not shown) positioned thereto. At the lower panel 27 of the duct bodies 24 and 27, the various electronic devices such as the heater 21 and the sensor (not shown) are positioned, and by placing the upper panel 24, the duct bodies 24 and 27 are assembled. As for the duct heads 23 and 28, the blower fan 22 is positioned at an inner side of the mounting portion 28, and the upper cover 24 is assembled.

The drying duct 20 is assembled at the cabinet 2. The drying duct 20 may be assembled to the front surface frame **2*a* of the cabinet 2. The drying duct 20 may be provided with a front surface panel 25 that is extended from the duct bodies 24 and 27. The front surface panel 25 and the front surface frame 2*a* of the cabinet 2 may be coupled to each other through a screw 29. At the front surface panel 25, a boss 26 through which the screw 29** may be inserted may be provided.

At a lower side of the front surface panel 25, a dry air flow path 25' configured to introduce the air at an inside of the drying duct 20 to the tub 3 may be formed.

The condensing duct 40 includes a body 41, 42, and 43 formed in a way to have one surface thereof open, and the body 41, 42, and 43 is composed of two front surface panels 42, two side surface panels 41 being connected to the two front surface panels 42, and an upper surface panel 43. At this time, the two front surface panels 42, the two side surface panels 41, and the upper surface panel 43 may be integrally formed. At the upper surface panel 43, an air inlet hole 45 is provided to introduce the air at an inside of the condensing duct 40 to the drying duct 20. The air inlet hole 45 may be connected to the drying duct 20 through the buffer coupling member 30. One of the two front surface panels 42 of the condensing duct 40 may be coupled to the tub 3, but the present disclosure is not limited hereto, as the condensing duct 40 may be coupled to the tub 3 without a front surface panel corresponding to a side that is being coupled to the tub 3. In the case as the above, the one side of the tub 3 that is coupled to the condensing duct 40 performs a role as the front surface panel of the condensing duct 40. At a lower side of the condensing duct 40, a coupling protrusion portion 44 may be provided to be coupled to the tub 3. One of the two front surface panels 42 of the condensing duct 40 may be fixed to the tub 3 in a closely adhered manner. The coupling of the condensing duct 40 to the tub 3 through the coupling protrusion portion 44 will be described later.

The condensing duct 40 and the drying duct 20 are coupled to each other through the buffer coupling member 30. To one side of the buffer coupling member 30, the condensing duct 40 is coupled, and to the other side of the buffer coupling member 30, the drying duct 20 is coupled. The buffer coupling member 30 may be provided in flexible material so that the length of the buffer coupling member 30 may be elastic. Thus, the buffer coupling member 30 may be able to prevent the vibration, which is generated at the condensing duct 40 due to the flow of the tub 3, from being delivered to the drying duct 20. In addition, the motion or the vibration of the tub 3 may be efficiently absorbed, as the buffer coupling member 30, which is positioned at an upper side of the tub 3, may be made to move having flexibility. That is, the buffer coupling member 30 is provided in a way that the condensing duct 40 is moved relative to the drying duct 20. Particularly, at an inner side of the drying duct 20, the heater 21 and a wire portion (not shown) being connected to the heater 21 are provided, and thus in a case when a vibration is being delivered, an abnormality may occur at the drying duct 20, but in accordance with the present disclosure, since the buffer coupling member 30 may be able to prevent the vibration from being delivered to the drying duct 20, the abnormality that may occur at the drying duct 20 may be prevented. According to the above, the vibration of the drum washing machine 1 being delivered to an outside may be prevented. The buffer coupling member 30 may be composed of a hose having the shape of a tube.

The buffer coupling member 30 may be provided in a hose 35 having a wrinkle portion 31, and in the case of the wrinkle portion 31, the wrinkle portion 31 may be provided with a structure of a mountain part 32 and a valley part 33 alternately disposed. The mountain part 32 and the valley part 33 are configured to have the exterior appearance of the wrinkle portion 31 easily changed when energy such as vibration is being delivered to the wrinkle portion 31, so that outside energy may be effectively absorbed in the process of the outside energy passing through the wrinkle portion 31.

The buffer coupling member 30 may be composed of plastic material having high-vibration, noise-reduction characteristic, such as T.P.E. (Thermoplastic elastomer), T.P.O. (Thermoplastic olefin elastomer), T.P.U. (Thermoplastic polyurethane), T.P.A.E. (Thermoplastic polyamide), and T.P.E.E. (Thermoplastic polyester elastomer), or may be composed of injection-molded substance of rubber material such as E.P.D.M. (Ethylene propylene dieneM-class). The buffer coupling member 30 composed with the plastic or the rubber material as such may be able to effectively absorb the vibration energy and the noise energy that are occurred by the flow of the tub 3.

The buffer coupling member 30 may further include a guide portion 34 to guide the coupling of the hose 35 to the drying duct 20. The guide portion 34 may be formed with plastic or rubber material having elasticity. The guide portion 34 is positioned in between the drying duct 20 and the hose 35, and while being coupled to the mounting unit 28 of the drying duct 20, guides the coupling of the hose 35 to the drying duct 20. That is, one side of the hose 35 is coupled to the guide portion 34, and the other side of the hose 35 is coupled to the upper surface panel 43 of the condensing duct 40.

The guide portion 34 is coupled to an inner side of the mounting unit 28 in a closely adhered manner, and the hose 35 is coupled to an outer side of the guide portion 34. When the buffer coupling member 30 coupled to the condensing duct 40 is coupled to the drying duct 20, the guide portion 34 is inserted into the drying duct 20 and then the hose 35 is inserted into the guide portion 34 and the drying duct 20, so the buffer coupling member 30 is assembled to the drying duct 20. The guide portion 34, not only to perform a role to mediate the coupling of the drying duct 32 and the hose 35, may enable the hose 35 to be easily assembled to the drying duct 32.

Figure 6:
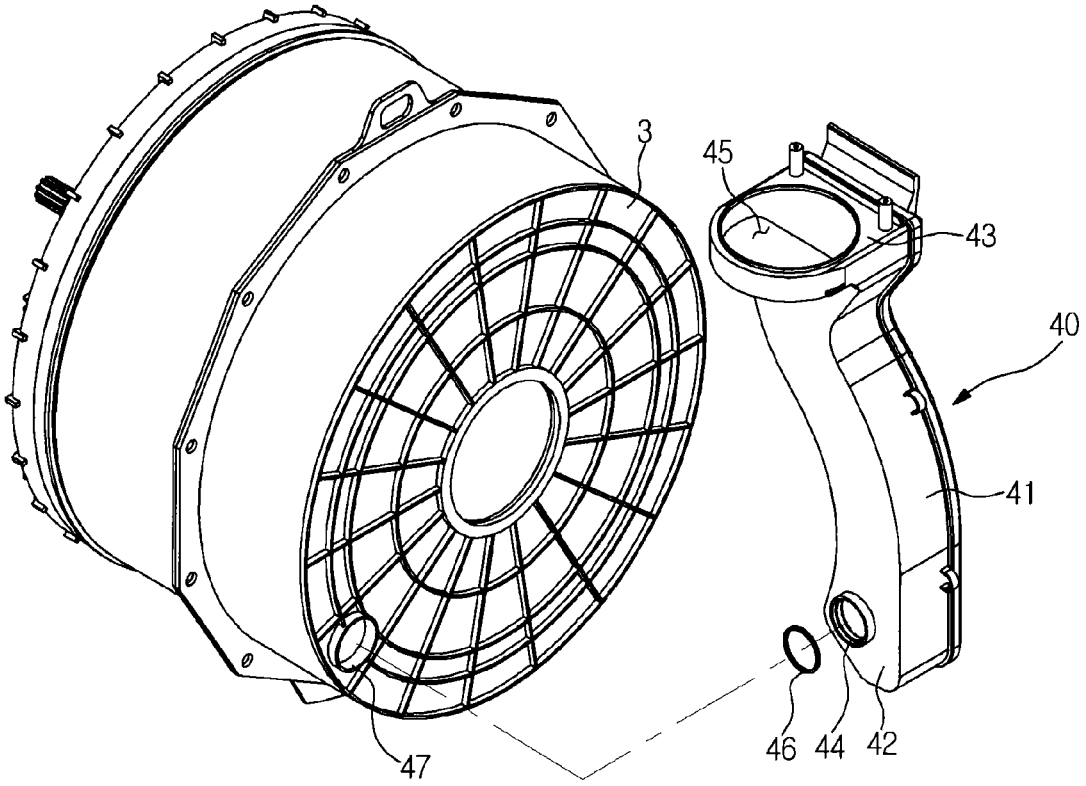
FIG. 6 is an exploded view illustrating a coupling portion of the condensing duct and a tub of the drum washing machine in accordance with one embodiment of the present disclosure.

FIG. 6 is an exploded view illustrating a coupling portion of the condensing duct and a tub of the drum washing machine in accordance with one embodiment of the present disclosure.

At a lower side of the condensing duct 40, the coupling protrusion portion 44 is provided for the coupling to the tub 3. With respect to the tub 3, to be coupled to the condensing duct 40, a coupling groove 47 is formed at a position corresponding to the coupling protrusion portion 44. Thus, the coupling protrusion portion 44 of the condensing duct 40 is inserted into the coupling groove 47 of the tub 3, and the coupling of the condensing duct 40 and the tub 3 takes place. On the drawing, the coupling groove 47 and the coupling protrusion portion 44 are illustrated to be positioned at a lower side of the condensing duct 40 and the tub 3, but the present disclosure is not limited hereto, and may be positioned at different positions. In addition, each of the coupling groove 47 and the coupling protrusion portion 44 may be provided in plural.

The condensing duct 40 is mounted at the tub 3, and may be coupled to the tub 3 in a way that the tub 3 may be sealed. For the above, in between the coupling protrusion unit 44 of the condensing duct 40 and the coupling groove 47 of the tub 3, a sealing member 46 of rubber material may be provided. The sealing member 46 is inserted around the coupling protrusion portion 44 of the condensing duct 40, and the coupling groove 47 of the tub 3 is inserted around the coupling protrusion portion 44. The sealing member 46 may be formed to correspond to the shape of the coupling protrusion portion 44 of the condensing duct 40. Since the coupling protrusion portion 44 of the condensing duct 40 is inserted into the coupling groove 47 of the tub 3, no separate space is needed for the coupling of the condensing duct 40. That is, the condensing duct 40 may be mounted at the tub 3 in a closely adhered manner.

According to the above, the flow path of air is described as follows. The drum 4 is rotatively installed at an inside of the tub 3, and a laundry is rotated at an inside of the drum 4, and is dried by the air that is circulated at an inside of the tub 3. The high-temperature, high-humidity air that absorbs the moisture included in the laundry at an inside of the drum 4 is introduced to the condensing duct 40 that is connected to the tub 3. The air introduced to the condensing duct 40 makes contact with the condenser 48, and through the heat exchange with condensation water, the moisture in the air is condensed. The condensation water formed in the process is dropped, and by passing through the tub 3, the connection hose 14, the drain pump 15, and the drain hose 17 in a sequential manner, is discharged to an outside the drum washing machine 1.

The air passed through the condensing duct 40 is introduced to the drying duct 20 in a state that most of the moisture in the air has been removed. The blower fan 22 induces the flow of the air as such. The air introduced to the drying duct 20, heated by the heater 21 at an inside of the drying duct 20, is introduced again to an inside of the tub 3 through the dry air flow path 25' in a high-temperature, dried state. The reason to provide the heater at an inside of the drying duct 20 and heat the air at the inside of the drying duct 20 is that the amount of the moisture that may be absorbed is increased as the temperature of the air is higher, and the moisture included in the laundry may be effectively absorbed.

The air in high-temperature and dried state being introduced to an inside of the tub 3, after absorbing the moisture included in the laundry at an inside of the drum 4, is introduced again to the condensing duct 40, and by repeating the process as such, the moisture included in the laundry is removed, and thus the laundry is dried.

In accordance with the present disclosure, since the condensing duct 40 having an simple assembly structure thereof is assembled to the tub 3 as the drying duct 20 is assembled to the cabinet 2, and thus the condensing duct 40 is being assembled to the tub 3, the space conventionally needed to assemble the condensing duct 40 may be reduced. According to the above, the space utilization is increased, and thus the increasing the size of the drum 4 may be possible without having to increase the overall size of the drum washing machine 1. Particularly, increasing the length of the drum 4 may be possible. Particularly, with respect to the present disclosure, in a case when the present disclosure is applied to the mid-to-small size standard washing machine having the dimensions of 600 mm×600 mm×850 mm that is being used in Europe, since the condensing duct 40 may be closely coupled to the tub 3 by the buffer coupling member 30, the space conventionally needed to couple the condensing duct 40 may be saved. In the case of applying the present disclosure to the mid-to-small size standard washing machine having the dimensions of 600 mm×600 mm×850 mm that is being used in Europe, the space of approximately 20 cm is secured, and through the secured space, without increasing the overall size of the drum washing machine 1, the length of the drum washing machine 1 may be expanded by approximately 20 cm. However, the expansion as such is not limited to approximately 20 cm, and depending on the design, making an adjustment by larger or smaller than approximately 20 cm may be possible. According to the above, since the capacity of the laundry that maybe accommodated at an inside of the drum 4 is increased, more laundry may be able to be processed at one time.

In addition, since the drying duct 20 is assembled to the cabinet 2, the vibration from the motion of the tub 3 may be absorbed. In addition, since the buffer coupling member 30 is provided in between the drying duct 20 and the condensing duct 40, and the buffer coupling member 30 as such may be composed of flexible material, the vibration, which is due to the flow of the tub 3, being delivered from the condensing duct 40 to the drying duct 20 may be efficiently absorbed.

Figure 7:
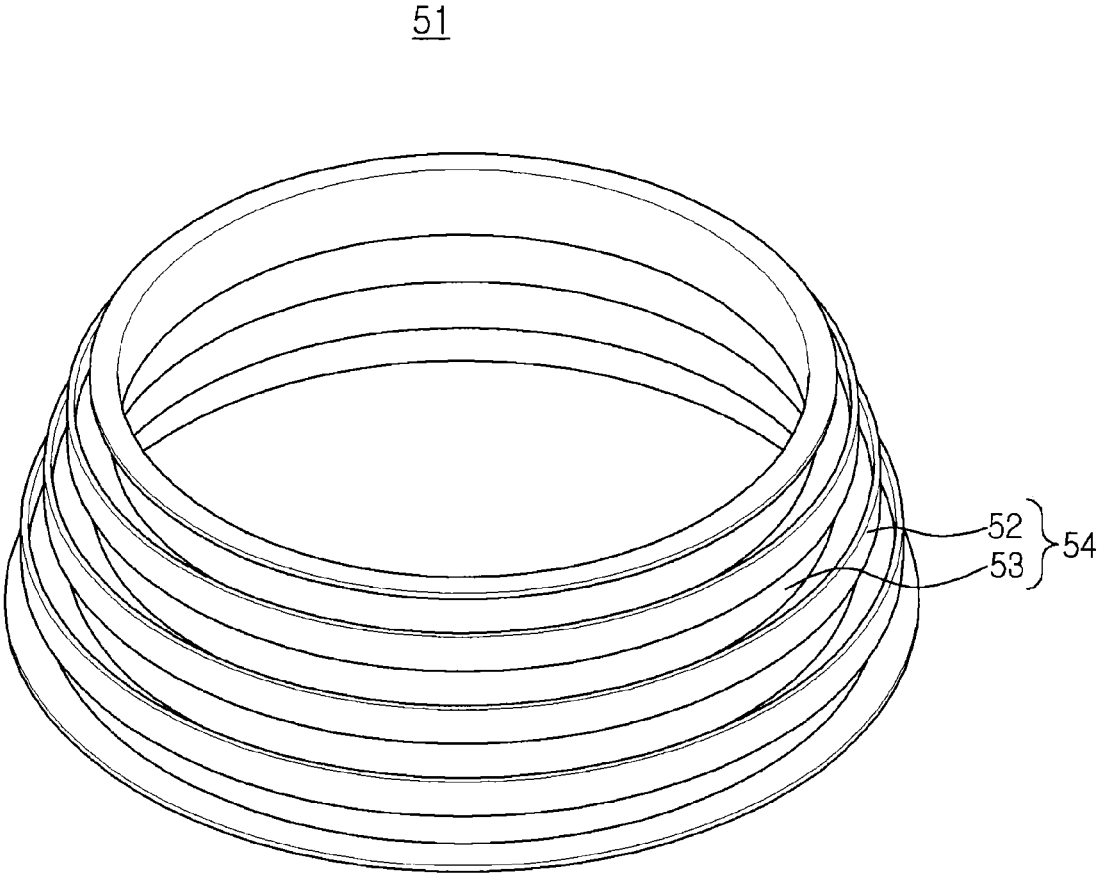
FIG. 7 is a drawing illustrating a buffer coupling member of a drum washing machine in accordance with another embodiment of the present disclosure.

FIG. 7 is a drawing illustrating a buffer coupling member of a drum washing machine in accordance with another embodiment of the present disclosure.

In a case of the buffer coupling member illustrated on FIG. 7, the buffer coupling member is same as the embodiments of the present disclosure illustrated on FIGS. 1 to 6 in that the buffer coupling member is provided as the pipe-shape hose of flexible material.

However, a wrinkle portion 51 of the buffer coupling member of FIG. 7 is different from the embodiment of the present disclosure illustrated on FIGS. 1 to 6 in that the width of the wrinkle portion 51 becomes narrower from a lower side of the winkle portion 51, which is coupled to the condensing duct 40 to an upper side of the wrinkle portion 51, which is coupled to the drying duct 20.

The wrinkle portion 51 includes a mountain-part 52 protruded toward an outer side, and a valley-part 53 recessed, and the mountain-part 52 and the valley-part 53 together form one single step portion 54. The wrinkle portion 51 may include a plurality of step portions 54, and the cross section of the step portion 54 is narrowed from the condensing duct 40 toward the direction of the drying duct 20. Since the cross section of the wrinkle portion 54 becomes narrower toward an upper side, the wrinkle portion 54 is moved in a way that an upper side thereof is accommodated in a lower side thereof. According to the above, the vibration that is generated at the tub 3 may be absorbed.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A drum washing machine, comprising:

a cabinet;

a tub disposed at an inside of the cabinet;

a drum rotatably disposed at an inside of the tub;

a condensing duct configured to condense moisture in air that is introduced from an inside of the drum; and a drying duct configured to heat air being introduced from the condensing duct to supply the heated air to an inside of the drum, wherein the condensing duct is coupled to a rear of the tub, the drying duct is positioned at an upper portion of the condensing duct and is coupled to the cabinet, a buffer coupling member is positioned in between the condensing duct and the drying duct, the buffer coupling member being configured to mediate the condensing duct and the drying duct, the buffer coupling member is composed of a pipe-shaped hose having an overall decreasing diameter in an upward direction whereby a cross sectional area of the buffer member connected to the condensing duct is greater than a cross sectional area of the buffer coupling member connected to the drying duct.

2. The drum washing machine of claim 1, wherein:

a front side panel of the condensing duct that composes the condensing duct is coupled to a rear surface of the tub in a closely adhered manner.

3. The drum washing machine of claim 1, wherein:

the buffer coupling member is formed of flexible material.

4. The drum washing machine of claim 1, wherein:

the buffer coupling member includes a wrinkle portion having a mountain part and a valley part alternately disposed.

5. The drum washing machine of claim 1, wherein:

the buffer coupling member includes at least one step portion having a width thereof being narrowed in a direction from the condensing duct to the drying duct.

6. The drum washing machine of claim 1, further comprising:

a guide portion provided in between the buffer coupling member and the drying duct, and configured to guide the coupling of the buffer coupling member and the drying duct.

7. The drum washing machine of claim 1, wherein:

the drying duct comprises a front surface panel to be coupled to the cabinet.

8. The drum washing machine of claim 7, wherein:

the front surface panel of the drying duct is fastened to the cabinet by using a screw.

9. The drum washing machine of claim 1, wherein:

the condensing duct comprises a coupling protrusion portion protruded toward an outer side of the condensing duct to be coupled to the tub, and the tub comprises a coupling groove to be coupled to the condensing duct, and the coupling protrusion portion of the condensing duct is insertedly assembled into the coupling groove of the tub.

10. The drum washing machine of claim 9, further comprising:

a sealing member in between the coupling protrusion portion of the condensing duct and the coupling groove of the tub to prevent air from leaking.

11. The drum washing machine of claim 1, wherein:

the condensing duct is fastened to the tub by using a screw.

12. A drum washing machine having a condensing duct and a drying duct, the drum washing machine comprising:

a cabinet;

a tub disposed at an inside of the cabinet;

a drum rotatably disposed at an inside of the tub;

a mounting portion having at least a portion thereof open for air to move is provided at one side of the drying duct; and a buffer coupling member configured to couple the drying duct to the condensing duct and configured to buffer a vibration of the drum washing machine mounted at the mounting portion, wherein the buffer coupling member is composed of a pipe-shaped hose having an overall decreasing diameter in an upward direction whereby a cross sectional area of an end of the buffer member coupled to the condensing duct is greater than a cross sectional area of an end of the buffer coupling member coupled to the drying duct.

13. The drum washing machine of claim 12, wherein:

the end of the buffer coupling member coupled to the drying duct is coupled to a rim portion of an inner side of the mounting portion, and the end of the buffer coupling member coupled to the drying duct is coupled to an outer side of the drying duct.

14. The drum washing machine of claim 12, wherein:

the buffer coupling member is configured to have flexibility so that a length of the buffer coupling member is contracted and extended.

15. The drum washing machine of claim 14, wherein:

the hose comprises a wrinkle portion having a mountain part and a valley part alternately disposed.

16. The drum washing machine of claim 14, wherein:

the hose comprises at least one step portion having a width thereof being narrowed in a direction from the condensing duct to the drying duct.

17. The drum washing machine of claim 12, further comprising:

a guide portion provided in between the buffer coupling member and the drying duct, and configured to guide the coupling of the buffer coupling member and the drying duct.

18. The drum washing machine of claim 17, wherein:

the guide portion is provided at an inner side of the buffer coupling member to mediate the drying duct and the buffer coupling member.

19. A drum washing machine, comprising:

a cabinet;

a tub disposed at an inside of the cabinet;

a drum rotatably disposed at an inside of the tub;

a condensing duct connected to the tub, and configured to condense moisture in air that is introduced from an inside of the drum;

a drying duct configured to heat air being introduced from the condensing duct to supply the heated air to an inside of the drum; and a buffer coupling member configured to connect the condensing duct to the drying duct to buffer a motion or a vibration of the tub from being delivered to the cabinet through the condensing duct, wherein the buffer coupling member is composed of a pipe-shaped hose having an overall decreasing diameter in an upward direction whereby a cross sectional area of the buffer member connected to the condensing duct is greater than a cross sectional area of the buffer coupling member connected to the drying duct.

20. The drum washing machine of claim 19, wherein:

the buffer coupling member is provided in a way that the condensing duct is moved relative to the drying duct, so as to buffer the motion or the vibration of the tub from being delivered to the drying duct through the condensing duct.

21. The drum washing machine of claim 19, wherein:

the drying duct is coupled to the cabinet.

22. The drum washing machine of claim 20, wherein:

the buffer coupling member is composed of flexible material.

23. The drum washing machine of claim 22, wherein:

the buffer coupling member comprises a wrinkle portion having a mountain part and a valley part alternately disposed.

* * * * *